US005490804A

United States Patent [19]

Blanchard et al.

[11] Patent Number: 5,490,804

[45] Date of Patent: Feb. 13, 1996

[54] MARINE PROPULSION UNIT HAVING EXTERIORLY ACCESSIBLE CLEAN-OUT CAPABILITY AND FLUSHING DEVICE FOR SAME

[75] Inventors: Clarence E. Blanchard; Duane E. Rogers, both of Kenosha, both of Wis.; Charles B. Hall, Ingleside, Ill.; Robert Mooney, Oak Creek; W. Scott Craig, Kenosha, both of Wis.; Dean P. Bergman, Waukegan, Ill.

[73] Assignee: Outboard Marine Corporation, Waukegan, Ill.

[21] Appl. No.: 313,538

[22] Filed: Sep. 27, 1994

Related U.S. Application Data

[63] Continuation of Ser. No. 147,976, Nov. 5, 1993, abandoned.

[51] Int. Cl.[6] ..... B63H 11/00

[52] U.S. Cl. ..... 440/38; 440/113

[58] Field of Search ..... 134/166 R, 167 R, 134/168 R, 169 R, 169 A, 201, 198; 440/53, 78, 88, 38, 39, 47, 900; 60/221; 417/360

[56] References Cited

U.S. PATENT DOCUMENTS

| | | | |
|---|---|---|---|
| 1,786,835 | 12/1930 | Evinrude | 440/78 |
| 2,047,330 | 7/1936 | Petersen | 417/360 |
| 2,884,862 | 5/1959 | Nielsen | 440/38 |
| 3,083,529 | 4/1963 | Hamilton | 440/38 |
| 3,105,353 | 10/1963 | Schulz | 440/39 |
| 3,279,414 | 10/1966 | Rabald | 440/38 |
| 3,520,272 | 7/1970 | Ellzey | 440/88 |
| 3,889,623 | 6/1975 | Arnold | 440/39 |
| 4,133,284 | 1/1979 | Holcroft | 440/88 |
| 4,459,117 | 7/1984 | Jordan | 440/38 |
| 4,600,394 | 7/1986 | Dritz | 440/38 |
| 4,897,023 | 1/1990 | Bingler | 417/360 |
| 5,123,867 | 6/1992 | Broinowski | 440/38 |
| 5,131,421 | 7/1992 | Hofbauer | 440/900 |
| 5,152,704 | 10/1992 | Carlson | 440/38 |
| 5,224,887 | 7/1993 | Futaki | 440/46 |
| 5,254,023 | 10/1993 | Kobayashi | 440/38 |

FOREIGN PATENT DOCUMENTS

| | | | |
|---|---|---|---|
| 764662 | 11/1966 | Italy | 440/38 |

OTHER PUBLICATIONS

Castoldi Jet Pump, Photograph, circa. 1992.

Advertising brochure entitled "Jet 07", Castoldi S.p.A., Milano, Italy, 12 pp.

Advertising brochure entitled "Jet 03", Castoldi S.p.A., Milano, Italy, 6 pp.

Coles, et al., "Seloc's Marine Jet Drive," 1961–1991, pp. 2–2, 6–14, and 7–1, published 1991.

Coles, et al., "Seloc's Personal Watercraft," vol. I, p. 4–3, published 1991.

Coles, et al., "Seloc's Personal Watercraft," vol. II, pp. 1–5 and 10–6–10–8, published 1991.

Coles, et al., "Seloc's Personal Watercraft," vol. III, p. 10–35, published 1991.

*Primary Examiner*—Edwin L. Swinehart

*Attorney, Agent, or Firm*—Greer, Burns & Crain, Ltd.

[57] ABSTRACT

A marine propulsion unit is disclosed which has an exteriorly accessible clean-out capability. The unit has an impeller housing located outside of the transom of a marine craft in which the unit is installed, which impeller housing has a separable portion that permits access to the main passage including the impeller when separated. The design also permits insertion of a hose connected fitting for backflushing the cooling system of the power head of the unit.

25 Claims, 4 Drawing Sheets

MARINE PROPULSION UNIT HAVING EXTERIORLY ACCESSIBLE CLEAN-OUT CAPABILITY AND FLUSHING DEVICE FOR SAME

This is a continuation of application Ser. No. 08/147,976, filed on Nov. 5, 1993 now abandoned.

CROSS REFERENCE TO RELATED APPLICATIONS

Adaptor Plate Mounting System for Marine Jet Propulsion Unit, Serial No. 08/147,880, filed Nov. 5, 1993, by Blanchard et al.

Jet Pump Exhaust System, Ser. No. 08/147,973, filed Nov. 5, 1993, by Craig et al.

Jet Pump Mounting System, Ser. No. 08/147,933, filed Nov. 5, 1993 by Craig et al.

BACKGROUND OF THE INVENTION

The present invention relates generally to marine jet propulsion units, and specifically to relatively higher-powered, inboard mounted marine jet propulsion units having indirect drive systems.

The popularity of jet propulsion units for powering small marine craft such as jet skis, as well as larger pleasure boats continues to increase for many reasons. These jet propulsion units are being used as replacements for propeller driven outboard or inboard marine motors. Some of the more significant advantages of jet propulsion units include the lack of a depending gear case, which allows the craft to virtually "float" above the water surface at high speed, thus enabling the operator to make tight turns while maintaining the boat in a generally horizontal or level orientation. Another advantage of marine jet propulsion units is the absence of an exposed propeller which enables the craft to be operated in shallower water without fouling.

Even though the use of jet propulsion units enables watercraft to be operated in shallower water, such units do exhibit the possibility for fouling and such fouling generally occurs as a result of taking in weeds or other debris into the intake of the unit.

It is a common design for such jet propulsion units to have a grill located on the intake so that large objects cannot enter the intake passage and eventually reach the impeller, but it is not entirely possible to keep weeds and other smaller debris from doing so. It is also common that debris may accumulate on the outside of the grill and eventually reduce or almost stop the flow of water through the propeller unit which will greatly affect the performance of the unit. If the debris enters the intake passage, it will generally pass through to the impeller where it may stop the impeller and kill the engine.

Assuming that debris does enter the intake and obstruct the main passage and necessitate that it be cleaned out, the access to the interior passage and impeller is often difficult in many prior art designs. Since the power head and gear housing are generally inside of the watercraft, there are conventional designs which have an access or door inside of the watercraft which can be removed or opened and the debris can be cleaned out. There are often two problems associated with this design. One is that since the power head and gear housing are inside of the watercraft, there may not be much room in which a person can maneuver to clean out the debris. Also, since the problem will probably result during operation, the motor may be hot and provide a safety hazard to someone attempting to do a clean out operation.

Accordingly, it is a primary object of the present invention to provide a marine propulsion unit having an impeller and main water passage that is accessible from outside of the watercraft.

A related object is to provide such a marine propulsion unit which is easily accessible from outside of the watercraft and which provides a generous accessibility to the impeller which promotes cleaning thereof.

Another related object lies in the provision for separating the drive shaft of the impeller from the impeller itself which can greatly facilitate the removal of debris, particularly if the debris comprises wire, elongated plant material or the like, which may be wound on the drive shaft and/or the impeller.

Still another object of the present invention is to provide such a marine propulsion unit which has an impeller housing located outside of the transom of the watercraft, a portion of which housing is adapted to be separated from the remainder thereof to expose the inside the housing where the impeller is located.

Still another object of the present invention lies in the provision for rotatably journaling the impeller within the impeller housing so that the drive shaft which is connected to the gear train in the gear housing can separate from the impeller when the separable portion of the impeller housing is moved away from the transom.

Yet another object of the present invention is to provide an alternative embodiment whereby the separable portion of the impeller housing can be pivoted away from the transom by virtue of a hinged connection on one side of the impeller housing.

Another object of the present invention is to provide a simple and convenient apparatus for flushing the water cooling system of the power head that is possible as a result of the separability of the portion of the impeller housing.

A further object of the present invention is to provide a pressure relief apparatus for controlling the amount of coolant diverted to the power head by the impeller.

These and other objects will become apparent upon reading the following detailed description while referring to the attached drawings.

DESCRIPTION OF THE PREFERRED EMBODIMENT

Figure 1:
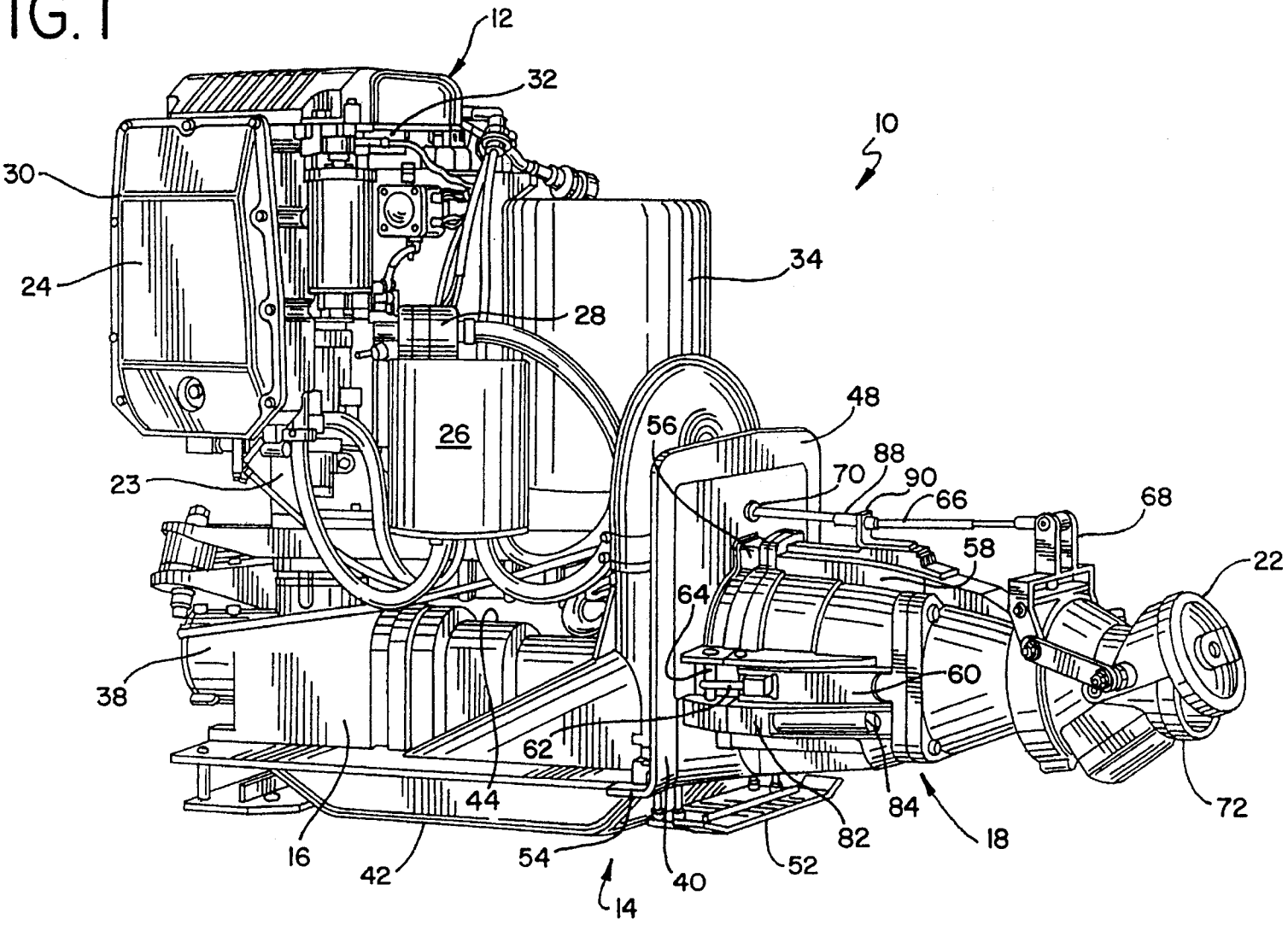
FIG. 1 is a perspective view of a marine power head and marine propulsion unit employing the present invention.

Broadly stated, the present invention is directed to a marine propulsion unit, (also commonly referred to in the art as a jet pump or jet propulsion unit) that has an exteriorly accessible clean out capability. The present invention facilitates efficient and easy clean out of debris from an impeller or the main inside passage of the propulsion unit.

The present invention essentially comprises a power head that is attached to a gear housing or water inlet housing, both the power head and the housing are located within the watercraft, the gear housing having an inlet for receiving water that is pumped through the main passage of the propulsion unit with the inlet being preferably at the bottom of the gear housing and generally coextensive with the outside surface of the watercraft at that point.

The gear housing extends rearwardly to the transom and an impeller housing is connected to the gear housing generally at the transom. For purposes of discussion herein, the gear housing is generally forward of the transom and the impeller housing is generally rearwardly of the transom, but it should be understood that the transom need not necessarily be the line of demarcation between the housings. As a matter of fact, the gear housing and at least a portion of the impeller housing may be integrally formed during the manufacturing process.

The impeller housing has a rearward portion that is structured to be separable from the remainder of the impeller housing that is near the transom. By separating the separable portion from the remainder, the impeller can be accessed as can the main passage forwardly or upstream of the impeller, including the portion of the passage in the gear housing so that debris or the like can be removed from the impeller and the main passage if it becomes clogged. The separable portion can either be slid away from the transom on sliding rods or in an alternative embodiment, can be pivoted away by virtue of a hinge connection on one side of the impeller housing. One or more suitable clamps securely attach the separable portion from the remainder of the impeller housing.

Another important feature of the present invention is that a simple fitting can be connected to an ordinary water hose and can be connected to an internal port that is exposed when the separable portion of the impeller housing is separated from the remainder thereof, with the fitting being adapted to backflush the cooling system of the power head easily by merely inserting the fitting within a port and turning on the hose.

Of particular advantage is the fact that the clean out as well as the flushing capability can be carried out quite easily because the separable portion is on the outside of the watercraft. The propulsion unit is adapted to steer the watercraft by being horizontally pivotable relative to the transom of the watercraft, and it also contains a reversing gate that can be moved into and out of contact with the jet of water during operation which gate has the effect of deflecting the flow of the jet in the reverse direction to provide a reverse propulsion capability. Additionally, the gate can be moved into an intermediate position whereby part of the jet is reversed and part is not, thereby providing a neutral propulsion capability.

Turning now to the drawings, and particularly FIG. 1, a marine jet propulsion unit embodying the present invention is indicated generally at 10. The unit 10 is designed for mounting inboard fashion into the hull of a watercraft, preferably a multi-passenger boat. However, the use of the present propulsion unit with other appropriate watercraft is contemplated. Major components of the propulsion unit 10 are a power head, indicated generally at 12, and a pump unit, indicated generally at 14. The pump unit includes a gear housing 16, also referred to as a water inlet housing which provides a mounting structure for the power head and contains the gear train for connecting the power head to the impeller, as well as the inlet for the water being pumped. It will be appreciated that while the preferred embodiment includes a gear housing 16 having a gear train for driving the impeller, it is contemplated that the present releasable impeller housing and the backflushing feature may also be employed on propulsion units in which the power head is directly connected to the impeller.

Figure 5:
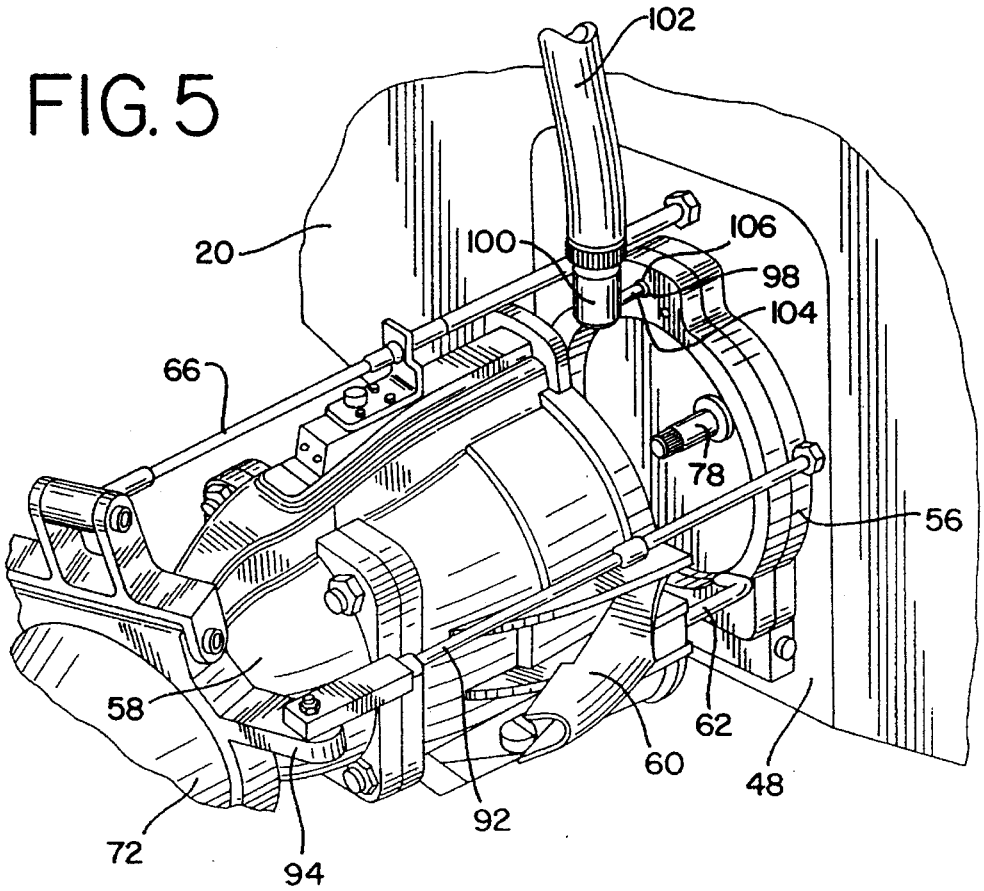
FIG. 5 is a perspective view, similar to FIG. 2, illustrating the clean out device being installed for use in the marine propulsion unit.

The pump unit 14 also includes an impeller housing 18 that is located outside of the watercraft, i.e., on the other side of a boat transom 20 (see FIGS. 2,3 and 5) from the gear housing 16, and there is a reverse gate 22 connected to the impeller housing 18 for providing directional control of the unit 10.

The power head 12 in the preferred embodiment is a conventional three cylinder, two-cycle marine power unit having an engine block 23, an air silencer device 24, a fuel pump 26, a fuel filter 28 connected to the fuel pump, an electric starter 30 connected to a flywheel assembly 32, and a muffler 34. The power head 12 is preferably of the type which is capable of generating in the range of 70–90 horsepower, although power units of both smaller and larger power ratings are suitable for use with the present invention. The power head 12 also includes a drive shaft (not shown) of the type which is well known in the art and is disclosed in commonly assigned U.S. Pat. No. 4,708,673 which is incorporated by reference herein.

Referring now to the pump unit 14, the unit includes the gear housing 16, having a fore end 38, an aft end 40, an underside 42 and an upper surface 44. A water intake covered by a grille (neither being shown) is located in the underside 42 which communicates water into the main passage 46 that extends from the intake through the gear housing 16 to the aft end 40 and then to the impeller housing. A transom plate 48 is located at the aft end 40 and is integrally formed with the gear housing 16, as by casting. An exhaust hose 50 communicates the power head exhaust through the impeller housing 18. A ride plate 52 is located on the underside 42 of the housing 16, in vertically spaced, depending relationship relative to a lower end 54 of the transom plate 48.

The impeller housing 18 has a fore portion 56 and a separable portion 58 that is releasably connected to the fore portion 56. In the preferred embodiment shown in FIGS. 1, 2 and 5, the separable portion 48 is releasably secured by a pair of clamps 60, each of which include a hook portion 62 constructed and arranged to engage a post 64 secured to the fore portion 56. The clamps 60 are preferably of the over-center type which are biased in a closed position once they are locked, and will not release unless an operator opens them. A gear shift cable 66 is connected to the reverse gate 22 through a linkage 68 and passes through a grommeted aperture 70 in the transom plate 48.

The gear shift cable 66 is adapted to control the vertical position of the gate 22 via the linkage 68 and thereby control the direction of propulsion of the unit 10. When the gate 22 is fully elevated, it is out of position to intercept the flow of water being expelled from a nozzle portion 72. When it is fully lowered to intercept the flow, it deflects the flow to the rear and thereby propels the watercraft in the reverse direction.

It should be understood that when the unit is operating the impeller is continually being driven so that flow will always be expelled through the unit. When the gate 22 is partially lowered as shown in FIG. 1, it will deflect some of the flow and not the remainder. This has the effect of providing a neutral position.

Figure 2:
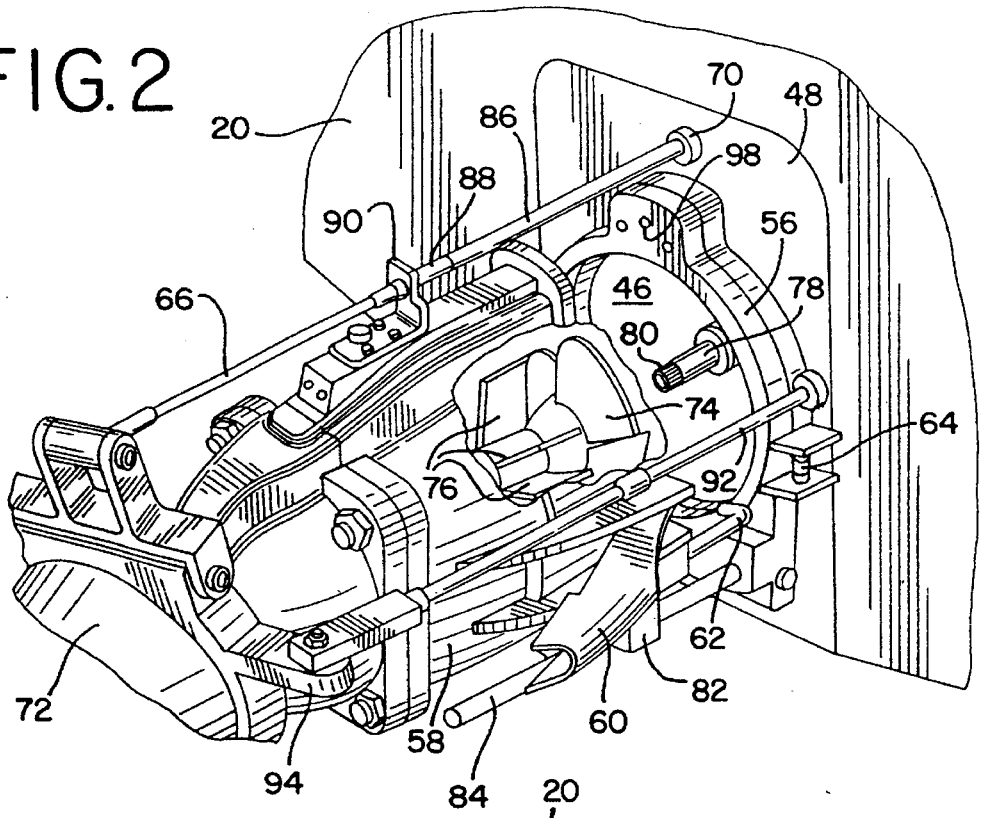
FIG. 2 is an exploded perspective elevational view of a portion of the marine propulsion unit shown in FIG. 1, with portions broken away, and taken from the opposite side of the assembly.

With respect to the preferred embodiment, and referring to FIG. 2, separable portion 58 is shown with portions broken away to reveal an impeller 74 having a number of vanes, three of which are shown. In the aft direction of the impeller 74, i.e., left as shown in FIG. 2, are a number of axial oriented stationary vanes 76 which function to straighten out the water flow produced by the impeller during operation. The stationary vanes 76 are formed in the portion 58 and extend from the outer periphery to a central hub, the hub having bearings (not shown) for journaling the impeller for rotation. By journaling the impeller in the separable portion 58, the separable portion can then be separated from the stationary portion 56 of the impeller housing.

In accordance with an important aspect of the present invention, the separation of the separable portion 58 from the portion 56 also removes the connection of the impeller 74 from a power output drive shaft 78 that is part of the gear train that interconnects the power head to the impeller 74. It will be appreciated that the drive shaft 78 may provide either a direct connection between the power head and the impeller, or form a portion of an indirect connection through a gear train as is well known in the art. The drive shaft 78 preferably has axially oriented splines 80 that cooperatively engage a splined aperture (not shown) in the impeller 74, so that when the separable portion 58 is returned to snugly fit against the stationary portion 56, and the clamps 60 are engaged, the drive shaft engages the impeller and is adapted to drive the same.

In the preferred embodiment, the separable portion 58 has an aperture in two extensions 82 which are located on opposite sides of the portion 58. An elongated rod 84 is secured to the stationary portion 58 and extends in the aft direction through the apertures in the extensions 82. The separable portion is thereby slidable on the rods between the operable position shown in FIG. 1 and the separated position shown in FIG. 2. The gear shift cable 66 comprises an outer sheath portion 86 in which the cable 66 can be moved, and the sheath portion 86 has a fitting 88 having an outer groove which is adapted to be retained by a holding member 90 to keep the outer sheath portion 86 from moving in the direction of the cable. Thus when the holding member 90 has the fitting 88 in place, only the cable 66 can move to change the position of the gate 22. The holding member 90 has a moveable lock portion which clamps the fitting, but can be released to enable the fitting to be disengaged from the holding member. When disengaged, the sheath portion can also slide relative to the grommet 70 and there is sufficient slack in the sheath portion to permit the separable portion 58 to slide a sufficient distance from the stationary portion 56 to permit a person to access the passage 46 and clean out any debris that may be present. The slack in the sheath portion 86 is not so great that the separable portion 58 can be moved so far that it can fall off the rods 84.

Steering of the unit is accomplished by another linkage 92 which is connected to an ear 94 attached to the nozzle portion 72 which is horizontally pivotable for directing the nozzle to steer the unit.

Figure 3:
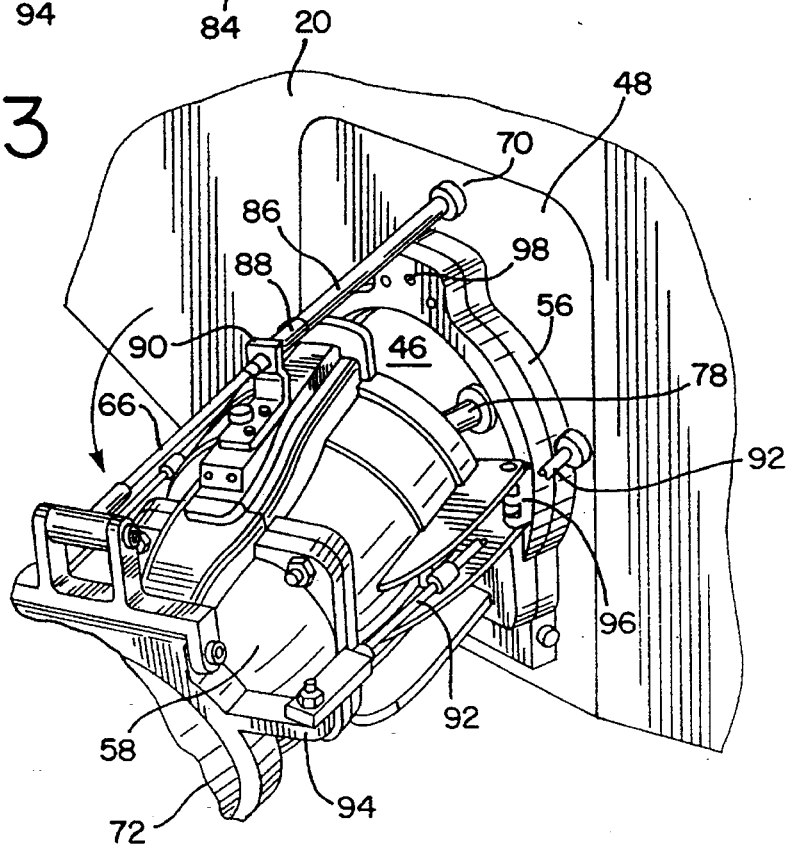
FIG. 3 is a perspective elevational view of an alternative embodiment of the marine propulsion unit.

An alternative embodiment is shown in FIG. 3 and utilizes a different type of separating mechanism in that it is pivotable rather than slidable. Thus, a hinged connection 96 is provided on one side, and only one clamp 60 needs to be provided on the opposite side. With such a pivotable connection, the interconnection of the drive shaft 78 and the impeller must be such that separation can occur due to the angular movement of the impeller relative to the drive shaft 78 during initial pivoting.

In accordance with another important aspect of the present invention, the accessibility to the impeller and the main passage 46 of the unit also results in a benefit in that the cooling system can also be easily accessed when the separable portion 58 is separated. As is well known to designers of marine propulsion units, power heads are often cooled with ambient water which is drawn into an internal cooling jacket or gallery. The coolant circulates throughout the cooling jacket to dissipate heat generated by the power head. Such a system is described in U.S. Pat. No. 5,049,101 which is incorporated by reference. To prevent corrosion of the water jacket, as well as other portions of the power head, it is advisable to provide a mechanism for flushing the cooling system with fresh tap water. This process is especially recommended when the propulsion unit 10 is operated in salt water or polluted waters. The cooling system of the power head 12 includes such a cooling jacket, as well as internal ports which communicate the cooling water to the main passage 46 downstream of the impeller. This port is shown at 98 in the stationary portion 56 and it communicates with a coextensive port in the separable portion 58 when these portions are abutting. However, when the separable portion 58 is separated, the port 98 is exposed and is adapted to have a fitting inserted therein, through which water can be pumped to backflush the cooling system if desired.

Figure 4:
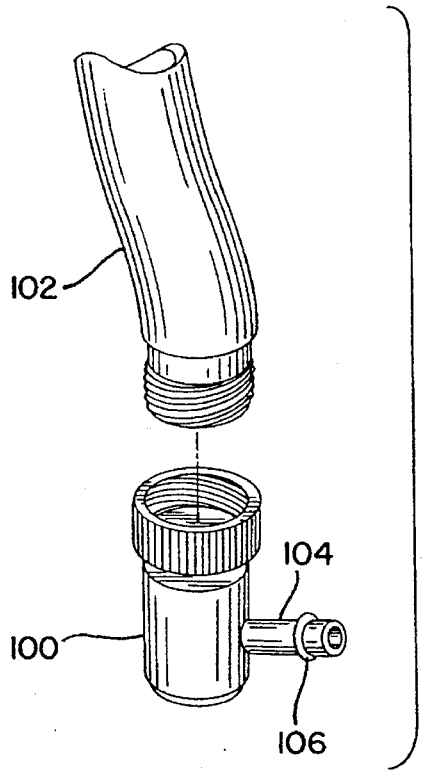
FIG. 4 is a perspective of a clean out device that can be used to flush the cooling system of the power head, that is conveniently possible in the present invention.

Turning to FIG. 4, a fitting 100 is provided which is adapted to be threadably connected to an ordinary garden hose 102 or the like, and the fitting has a small tube portion 104 having an outer diameter slightly smaller than the internal diameter of the port 98. The portion 104 also has an O-ring seal 106 for providing a sealing engagement of the tube portion 104 and the port 98. The fitting is shown installed for backflushing in FIG. 5.

Figure 6:
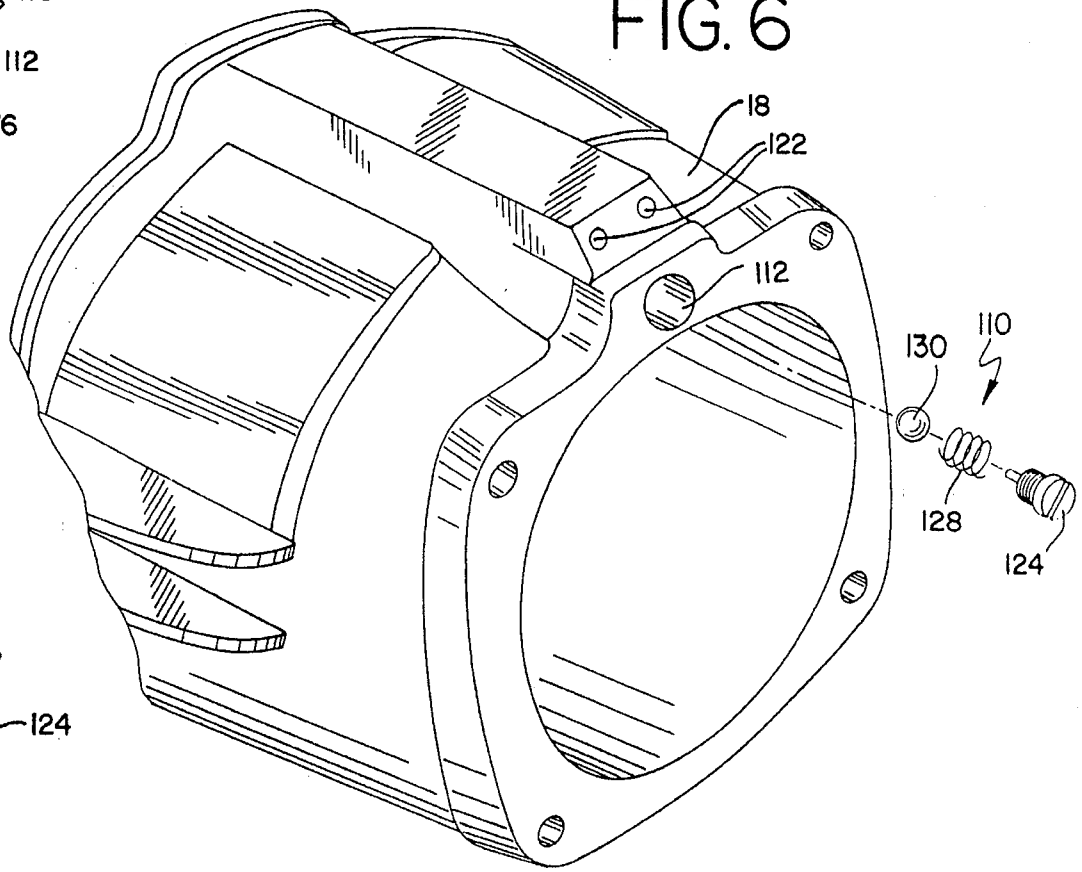
FIG. 6 is an exploded perspective elevational view of the impeller housing of the present propulsion unit, showing the pressure relief valve.
Figure 7:
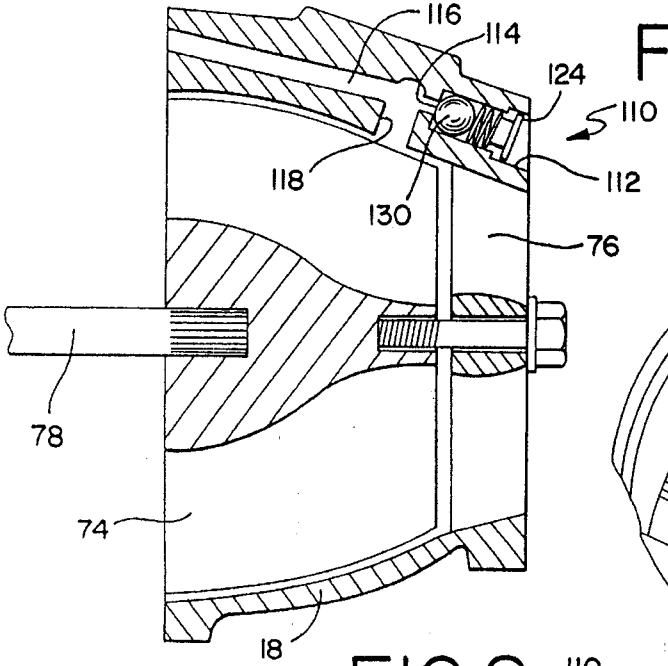
FIG. 7 is a diagrammatic vertical sectional view of the impeller housing of the present propulsion unit.
Figure 8:
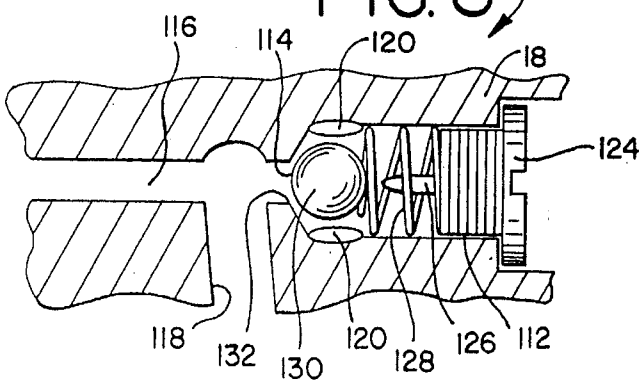
FIG. 8 is an enlarged fragmentary sectional view of the pressure relief valve mounted in the impeller housing.

Referring now to FIGS. 6–8, another feature of the present jet propulsion unit 10 is depicted. This feature relates to the maintenance of a specified pressure of coolant in the power head cooling jacket. In the unit 10, the cooling water supplied to the power head 12 is diverted from the flow of high pressure water in the main passage 46 which is generated by the impeller 74. Due to the relatively high pressures generated by the unit 10, cooling water diverted to the power unit may exceed the capacity of the cooling jacket. To control the pressure of coolant sent to the power head, a pressure relief valve, generally designated 110, is installed in the impeller housing 18 and is in fluid communication with the cooling jacket.

More specifically, at the aft end of the impeller housing 18 is located a valve chamber 112 having a port 114 in communication with a fluid passageway 116 through which coolant is diverted from the passage 46. Water is forced at high pressure by the impeller 74 into an entry port 118 of the passageway 116. Also included in the valve chamber 112 is at least one and preferably two pressure relief ports 120 which are in fluid communication with pressure relief blowout apertures 122 located on the outside of the impeller housing.

The chamber 112 is dimensioned to accommodate the valve 110, which is preferably a check valve including a threaded plug 124 with an axially extending projection 126. The plug 124 is preferably threadably engaged in the chamber 112. A coiled spring 128 is held in axially aligned position in the chamber by the projection 126. The spring 128 is located between the plug 124 and a ball 130 which is preferably made of rigid, corrosion resistant material such as stainless steel.

During normal operation of the propulsion unit 10, the ball 130 is held by the spring 128 against a seat 132 defined by the port 114. This seated relationship of the ball seals the chamber 112 from the coolant passageway 116. In the event the pressure of the coolant forced through the passageway by the impeller exceeds the biasing force of the spring 128, the ball will be forced aft into the chamber 112. Once the ball 130 becomes unseated, water may enter the chamber 112 and be diverted into the pressure relief ports 120. Eventually, the excess pressurized coolant is exhausted through the blow-out apertures 122. It will be appreciated that the release point of the ball 130 may be regulated by the strength of the spring 128.

From the foregoing description, it should be understood that an improved marine propulsion unit has been shown and described which has the significant advantage of being accessible from outside of the watercraft in which the unit is installed. The outside accessibility greatly facilitates easy removal of debris from the main water passage and from the impeller itself. The design and construction which permits easy accessibility also separates the drive shaft which is coupled to the impeller during normal operation, and such separation will also facilitate more easy removal of debris which may be wrapped around the drive shaft and impeller. The design also enables the cooling system of the power head to be flushed out by the simple insertion of a hose coupled fitting within an exposed port of the unit. Furthermore, the pressure of coolant diverted from the impeller housing to the power head is maintained by a pressure relief valve to prevent damage to the power head.

While various embodiments of the present invention have been shown and described, it should be understood that various alternatives, substitutions and equivalents can be used, and the present invention should only be limited by the claims and equivalents of the claims.

Various features of the present invention are set forth in the following claims.

What is claimed is:

1. A jet propulsion unit for a marine craft, comprising:

a power head for powering the unit, said power head having an output drive shaft;

impeller means for driving water through the unit for propelling the marine craft;

a water inlet housing providing a mounting structure for mounting said power head thereto;

said impeller means including an impeller housing having a passage therein and an rotatable impeller mounted to said housing and located within said passage, said impeller housing being connected to said water inlet housing, said water inlet housing having an intake passage for receiving water from adjacent the unit, said intake passage being in communication with said impeller housing passage;

a direction controlling outlet nozzle means attached to the rear portion of said impeller housing, said nozzle means being adapted to adjustably control the direction of the water being expelled from the unit during operation;

said impeller being releasably connected to said power head, at least a moveable portion of said impeller housing being reciprocally moveable and releasably clamped relative to said water inlet housing so that the interior of said impeller housing is accessible from the outside of the unit without requiring disassembly of said unit; and said moveable portion of said impeller housing is slidably connected to a remaining portion thereof remaining attached to said water inlet housing, so that said moveable portion can be linearly displaced from said remaining portion which being retained thereto, said impeller separating from connection to said power head as said portion is linearly displaced, thereby exposing said impeller and permitting cleaning of debris from the interior of said impeller housing and said impeller.

2. A jet propulsion unit as defined in claim 1 wherein said one of said moveable portion and said remaining portion includes at least two rod members and the other had cooperating apertures in which said rod members are slidable, said moveable portion being moveable relative to said remaining portion by said rod members sliding relative to said cooperating apertures.

3. A jet propulsion unit as defined in claim 2 further including at least one latch means adapted to releasably attach said moveable porting to said remaining portion, said latch means preventing said moveable portion to move relative to said remaining portion.

4. A jet propulsion unit as defined in claim 3 further including a latch means located on opposite sides of said moveable portion.

5. A jet propulsion unit as defined in claim 1 wherein said outlet nozzle means comprises a generally horizontally pivotable portion adapted to direct the expelled water from side to side during steering.

6. A jet propulsion unit as defined in claim 5 wherein said outlet nozzle means includes an adjustable deflecting gate means being adapted to divert at least a portion of the expelled water in a generally opposite direction, the position of the gate selectively determining one of a forward direction, a reverse direction or neutral.

7. A jet propulsion unit as defined in claim 1 wherein said power head comprises an internal combustion engine being water cooled and having a cooling water outlet port located in said water inlet housing and being aligned and in communication with a port in said impeller housing, said impeller housing water outlet port communicating the cooling water to said passage wherein said impeller is located, said water inlet housing water outlet port being exposed for connection to a fitting adapted to be in communication with a source of cleaning fluid when said portion of said impeller housing is moved relative to said water inlet housing and the interior of said impeller housing is accessible from the outside of the unit.

8. A jet propulsion unit as defined in claim 7 wherein said fitting comprises a coupling adapted to be connected to a flexible hose, and a hollow tube having a sealing means located on the outside thereof adapted to be frictionally attached to the inside of said water inlet housing water outlet port.

9. A jet pump for a marine craft, said jet pump comprising:

an internal combustion power head for powering the pump, said power head having an output drive shaft;

a housing adapted to be installed in a marine craft and having a first portion located substantially within the marine craft and including a structure associated with said power head and a second portion located outside of the marine craft, said first portion having an inlet passage for receiving water from adjacent the pump, and said second portion is slidably connected to the remaining portion thereof, so that said part can be moved away from said remaining portion, said impeller separating from said power output drive shaft as said part is moved away, thereby exposing said impeller and permitting cleaning of debris from the interior of said second portion and said impeller;

impeller means for pumping water through the pump for propelling the marine craft, said impeller means being mounted for rotation within a passage in said second portion;

coupling means for coupling said output drive shaft to said impeller means, said coupling means including a power output drive shaft that is releasably connected to said impeller means, said coupling means being primarily journaled in said first portion and having said power output drive shaft extending to said second portion;

a direction controlling outlet nozzle means attached to the rear portion of said second portion, said nozzle means being adapted to adjustably control the direction that the water is expelled from the pump; and said impeller means being releasably connected to said power output drive shaft, at least a part of said second portion being reciprocally moveable and releasably clamped relative to said first portion so that the interior of said second portion is accessible from the outside of the pump without requiring disassembly of said housing.

10. A jet pump as defined in claim 9 wherein said one of said part and said remaining portion includes at least two rod members and the other has cooperating apertures in which said rod members are slideable, said part being moveable relative to said remaining portion by said rod members sliding relative to said cooperating apertures.

11. A jet pump as defined in claim 9 further including at least one latch means adapted to releasably attach said part to said second portion, said latch means preventing said part from moving relative to said remaining portion.

12. A jet pump as defined in claim 11 further including a latch means located on opposite sides of said part.

13. A jet pump as defined in claim 9 wherein said outlet nozzle means comprises a generally horizontally pivotable portion adapted to direct the expelled water from side to side during steering.

14. A jet pump as defined in claim 13 wherein said outlet nozzle means includes an adjustable deflecting gate means being adapted to divert at least a portion of the expelled water in a generally opposite direction, the position of the gate selectively determining one of a forward direction, a reverse direction or neutral.

15. A jet pump as defined in claim 9 wherein said internal combustion power head is water cooled and has a cooling water outlet port located in said first portion and being aligned and in communication with a port in said second portion, said second water outlet port communicating the cooling water to said passage containing said impeller, said first portion outlet port being exposed for connection to a fitting adapted to be connected to a source of cleaning fluid when said first portion and the interior of said second portion is accessible from the outside of said pump.

16. A jet pump as defined in claim 15 wherein said fitting comprises a coupling adapted to be connected to a flexible hose, and a hollow tube having a sealing means located on the outside thereof adapted to be frictionally attached to the inside of said first portion water outlet port.

17. A jet propulsion unit for a marine craft, comprising:

a power head with a cooling jacket;

a pump unit connected to said power head for supplying coolant to said power head;

access means associated with said pump unit for accessing said cooling jacket and for introducing a flushing fluid therein;

said pump unit includes an impeller housing having a separable portion, and said access means includes an internal port in said impeller housing in communication with said cooling jacket which is accessible for introduction of flushing fluid only upon separation of said separable portion from said pump unit.

18. A jet propulsion unit as defined in claim 17 wherein said access means further includes a fitting which is adapted for connection to a source of flushing fluid, and which has a tube portion configured for releasable insertion into said internal port upon said port becoming accessible.

19. A jet propulsion unit as defined in claim 18 wherein said tube portion is provided with sealing means for sealing the tube in said port.

20. A jet propulsion unit as defined in claim 17 further including a fitting adapted for connection to a source of the flushing fluid and configured for releasable connection to said pump unit for introducing the flushing fluid into said cooling jacket.

21. A jet propulsion unit for a marine craft, comprising:

a power head for powering the unit, said power head having an output drive shaft;

impeller means for driving water through the unit for propelling the marine craft;

a water inlet housing providing a mounting structure for said power head;

said impeller means including an impeller housing having a passage therein and an rotatable impeller mounted to said housing and located within said passage, said impeller housing being connected to said water inlet housing, said water inlet housing having an intake passage for receiving water from adjacent the unit, said intake passage being in communication with said impeller housing passage;

a direction controlling outlet nozzle means attached to the rear portion of said impeller housing, said nozzle means being adapted to adjustably control the direction of the water being expelled from the unit during operation;

said impeller being releasably connected to said power head, at least a portion of said impeller housing being moveable relative to said water inlet housing so that the interior of said impeller housing is accessible from the outside of the unit; and wherein said power head comprises an internal combustion engine being water cooled and having a cooling water outlet port located in said water inlet housing and being aligned and in communication with a port in said impeller housing, said impeller housing water outlet port communicating the cooling water to said passage wherein said impeller is located, said water inlet housing water outlet port being exposed for connection to a fitting adapted to be in communication with a source of cleaning fluid when said portion of said impeller housing is moved relative to said water inlet housing and the interior of said impeller housing is accessible from the outside of the unit.

22. A jet propulsion unit as defined in claim 21 wherein said fitting comprises a coupling adapted to be connected to a flexible hose, and a hollow tube having a sealing means located on the outside thereof adapted to be frictionally attached to the inside of said water inlet housing water outlet port.

23. A jet propulsion unit for a marine craft, comprising:

a power head for powering the unit, said power head having an output drive shaft;

impeller means for driving water through the unit for propelling the marine craft;

a water inlet housing providing a mounting structure for mounting said power head thereto;

said impeller means including an impeller housing having a passage therein and an rotatable impeller mounted to said housing and located within said passage, said impeller housing being connected to said water inlet housing, said water inlet having an intake passage for receiving water from adjacent the unit, said intake passage being in communication with said impeller housing passage;

a direction controlling outlet nozzle means attached to the rear portion of said impeller housing, said nozzle means being adapted to adjustably control the direction of the water being expelled from the unit during operation;

said impeller being releasably connected to said power head, at least a moveable portion of said impeller housing being reciprocally moveable and releasably clamped relative to said water inlet housing so that the interior of said impeller housing is accessible from the outside of the unit without requiring disassembly of said unit; and a first side of said moveable portion of said impeller housing is hingedly connected to a remaining portion remaining attached to said water inlet housing thereof, so that said moveable portion can be pivoted away from said remaining portion, said impeller separating from said power head as said moveable portion is pivoted away, thereby exposing said impeller and permitting cleaning of debris from the interior of said impeller housing and said impeller.

24. A jet propulsion unit as defined in claim 23 further including a latch means adapted to releasably attach said moveable portion to said remaining portion, said latch means being located on the side opposite said first side.

25. A jet propulsion unit for a marine craft, comprising:

a power head for powering the unit and having a cooling jacket;

impeller means connected to said power head and constructed for driving water through the unit for propelling the marine craft;

water inlet means for supplying water to said impeller means;

said impeller means including an impeller housing having a passage therein and a rotatable impeller mounted to said housing and located within said passage, said impeller housing, having an outlet through which passes the water driven by said impeller means, said housing being connected to said water inlet means and including a passageway for fluid communication with said cooling jacket, said passageway having an entry port disposed in said passage adjacent said impeller so that water is forced into said passageway by said impeller; and pressure relief means for regulating the pressure of cooling water in said passageway for cooling said power head, said pressure relief means including a pressure regulated check valve disposed in a valve chamber in said impeller housing adjacent said outlet and in fluid communication with said passageway and with said entry port, and at least one pressure relief port in fluid communication with said valve for exhausting excess water driven into said entry port by said impeller.

* * * * *